US006471270B1

(12) United States Patent
Mituniewicz

(10) Patent No.: US 6,471,270 B1
(45) Date of Patent: Oct. 29, 2002

(54) INSULATION INSTALLING TOOL

(76) Inventor: Paul M. Mituniewicz, 5601 NW. Franklin St., Vancouver, WA (US) 98663

( * ) Notice: Subject to any disclaimer, the term of this patent is extended or adjusted under 35 U.S.C. 154(b) by 0 days.

(21) Appl. No.: 09/922,290

(22) Filed: Aug. 3, 2001

(51) Int. Cl.[7] ..... B25J 1/00
(52) U.S. Cl. ..... 294/19.1
(58) Field of Search ..... 294/15, 19.1, 22, 294/23, 24, 26, 61, 159; 414/10, 11

(56) References Cited

U.S. PATENT DOCUMENTS

| | | | | | |
|---|---|---|---|---|---|
| 824,968 | A | * | 7/1906 | Wright | 294/22 X |
| 1,833,120 | A | * | 11/1931 | Nitzsche | 294/22 |
| 1,978,659 | A | * | 10/1934 | Whittaker | 294/61 X |
| 3,822,023 | A | * | 7/1974 | Cordel | 414/11 |
| 4,019,769 | A | * | 4/1977 | Filion | 294/19.1 |
| 4,141,579 | A | * | 2/1979 | Moss | 294/61 |
| 4,261,607 | A | * | 4/1981 | Pilcher | 294/19.1 |
| 4,335,913 | A | * | 6/1982 | Lick | 294/19.1 |
| 4,653,142 | A | | 3/1987 | Upton | |
| 4,695,028 | A | * | 9/1987 | Hunter | 294/19.1 X |
| 5,099,539 | A | | 3/1992 | Forester | |
| 5,122,022 | A | | 6/1992 | Kluser | |
| 5,188,332 | A | * | 2/1993 | Callas | 294/19.1 X |
| 5,301,378 | A | | 4/1994 | Schultz | |
| D406,518 | S | | 3/1999 | Yenkala | |
| 6,017,070 | A | | 1/2000 | Poppa | |

FOREIGN PATENT DOCUMENTS

| | | | | |
|---|---|---|---|---|
| CA | 1057713 | * | 7/1979 | 294/159 |

* cited by examiner

*Primary Examiner*—Johnny D. Cherry

(57) ABSTRACT

An insulation installing tool for lifting and placing of insulation between wall and ceiling joists. The insulation installing tool includes an elongate member having a first end, a second end, and a peripheral wall extending between the first and second ends. A coupler is attached to the peripheral wall and is positioned generally between the first and second ends of the elongate member. A plurality of upstanding members is attached to and extends away from the peripheral wall of the elongate member. The upstanding members extend in a generally opposite way with respect to the coupler. Each of the upstanding members has a free end that is pointed. The upstanding members may be removably inserted into insulation for lifting and placing of the insulation.

7 Claims, 4 Drawing Sheets

INSULATION INSTALLING TOOL

BACKGROUND OF THE INVENTION

1. Field of the Invention

The present invention relates to insulation lifting devices and more particularly pertains to a new insulation installing tool for lifting and placing of insulation between wall and ceiling joists.

2. Description of the Prior Art

The use of insulation lifting devices is known in the prior art. More specifically, insulation lifting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,301,378; U.S. Pat. No. 6,017,070; U.S. Pat. No. 4,653,142; U.S. Pat. No. 5,099,539; U.S. Pat. No. 5,122,022; and U.S. Des. Pat. No. 406,518.

While these devices fulfill their respective, particular objectives and requirements, the aforementioned patents do not disclose a new insulation installing tool. The inventive device includes an elongate member having a first end, a second end, and a peripheral wall extending between the first and second ends. A coupler is attached to the peripheral wall and is positioned generally between the first and second ends of the elongate member. A plurality of upstanding members is attached to and extends away from the peripheral wall of the elongate member. The upstanding members extend in a generally opposite way with respect to the coupler. Each of the upstanding members has a free end that is pointed. The upstanding members may be removably inserted into insulation for lifting and placing of the insulation.

In these respects, the insulation installing tool according to the present invention substantially departs from the conventional concepts and designs of the prior art, and in so doing provides an apparatus primarily developed for the purpose of lifting and placing of insulation between wall and ceiling joists.

SUMMARY OF THE INVENTION

In view of the foregoing disadvantages inherent in the known types of insulation lifting devices now present in the prior art, the present invention provides a new insulation installing tool construction wherein the same can be utilized for lifting and placing of insulation between wall and ceiling joists.

The general purpose of the present invention, which will be described subsequently in greater detail, is to provide a new insulation installing tool apparatus and method which has many of the advantages of the insulation lifting devices mentioned heretofore and many novel features that result in a new insulation installing tool which is not anticipated, rendered obvious, suggested, or even implied by any of the prior art insulation lifting devices, either alone or in any combination thereof.

To attain this, the present invention generally comprises an elongate member having a first end, a second end, and a peripheral wall extending between the first and second ends. A coupler is attached to the peripheral wall and is positioned generally between the first and second ends of the elongate member. A plurality of upstanding members is attached to and extends away from the peripheral wall of the elongate member. The upstanding members extend in a generally opposite way with respect to the coupler. Each of the upstanding members has a free end that is pointed. The upstanding members may be removably inserted into insulation for lifting and placing of the insulation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new insulation installing tool apparatus and method which has many of the advantages of the insulation lifting devices mentioned heretofore and many novel features that result in a new insulation installing tool which is not anticipated, rendered obvious, suggested, or even implied by any of the prior art insulation lifting devices, either alone or in any combination thereof.

It is another object of the present invention to provide a new insulation installing tool which may be easily and efficiently manufactured and marketed.

It is a further object of the present invention to provide a new insulation installing tool which is of a durable and reliable construction.

An even further object of the present invention is to provide a new insulation installing tool which is susceptible of a low cost of manufacture with regard to both materials and labor, and which accordingly is then susceptible of low prices of sale to the consuming public, thereby making such insulation installing tool economically available to the buying public.

Still yet another object of the present invention is to provide a new insulation installing tool which provides in the apparatuses and methods of the prior art some of the advantages thereof, while simultaneously overcoming some of the disadvantages normally associated therewith.

Still another object of the present invention is to provide a new insulation installing tool for lifting and placing of insulation between wall and ceiling joists.

Yet another object of the present invention is to provide a new insulation installing tool which includes an elongate member having a first end, a second end, and a peripheral wall extending between the first and second ends. A coupler is attached to the peripheral wall and is positioned generally between the first and second ends of the elongate member. A plurality of upstanding members is attached to and extends away from the peripheral wall of the elongate member. The upstanding members extend in a generally opposite way with respect to the coupler. Each of the upstanding members has a free end that is pointed. The upstanding members may be removably inserted into insulation for lifting and placing of the insulation.

Still yet another object of the present invention is to provide a new insulation installing tool that has a channel adapted for holding a stay rod which will hold the insulation in position after being lifted by the device.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
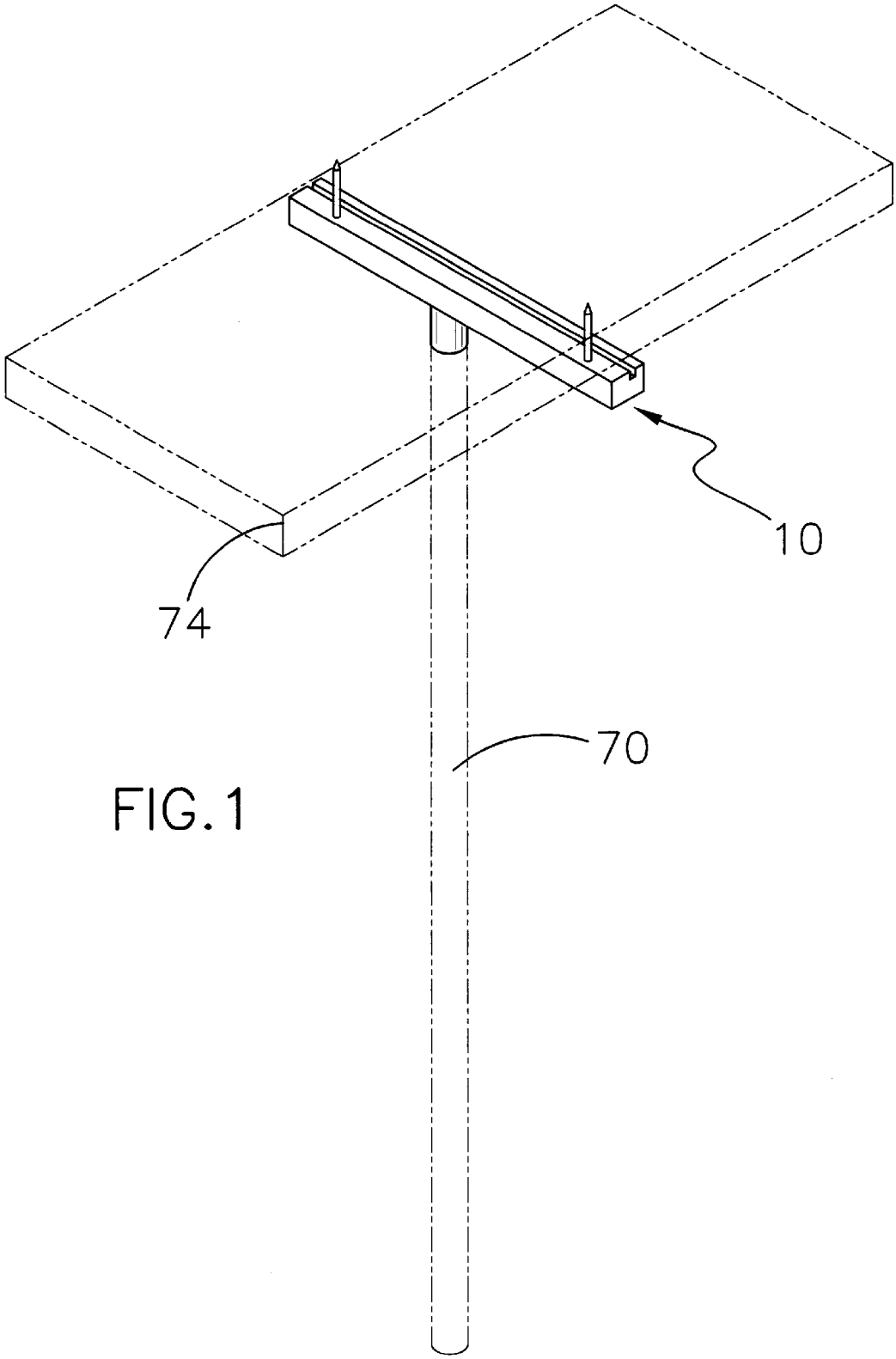
FIG. 1 is a schematic perspective view of a new insulation installing tool according to the present invention.
Figure 2:
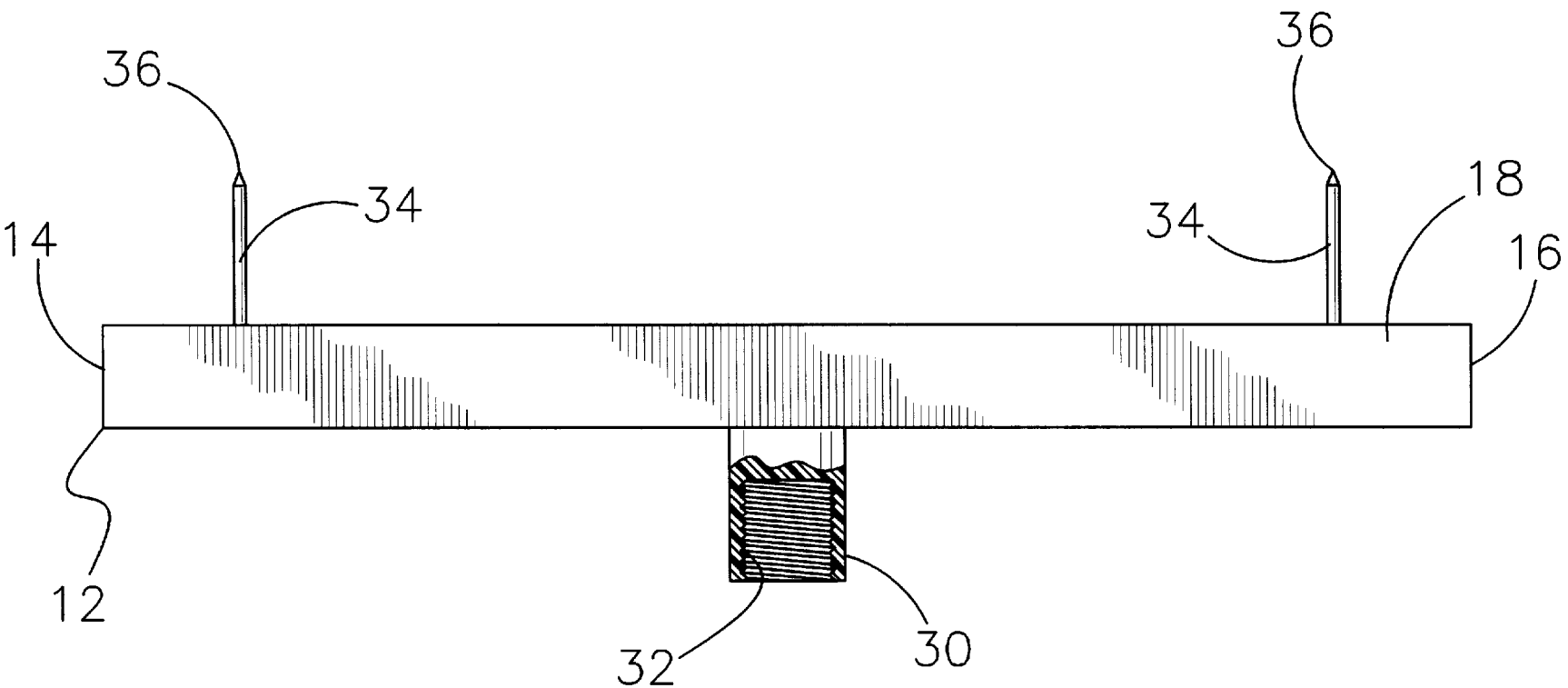
FIG. 2 is a schematic side view of the present invention.
Figure 3:
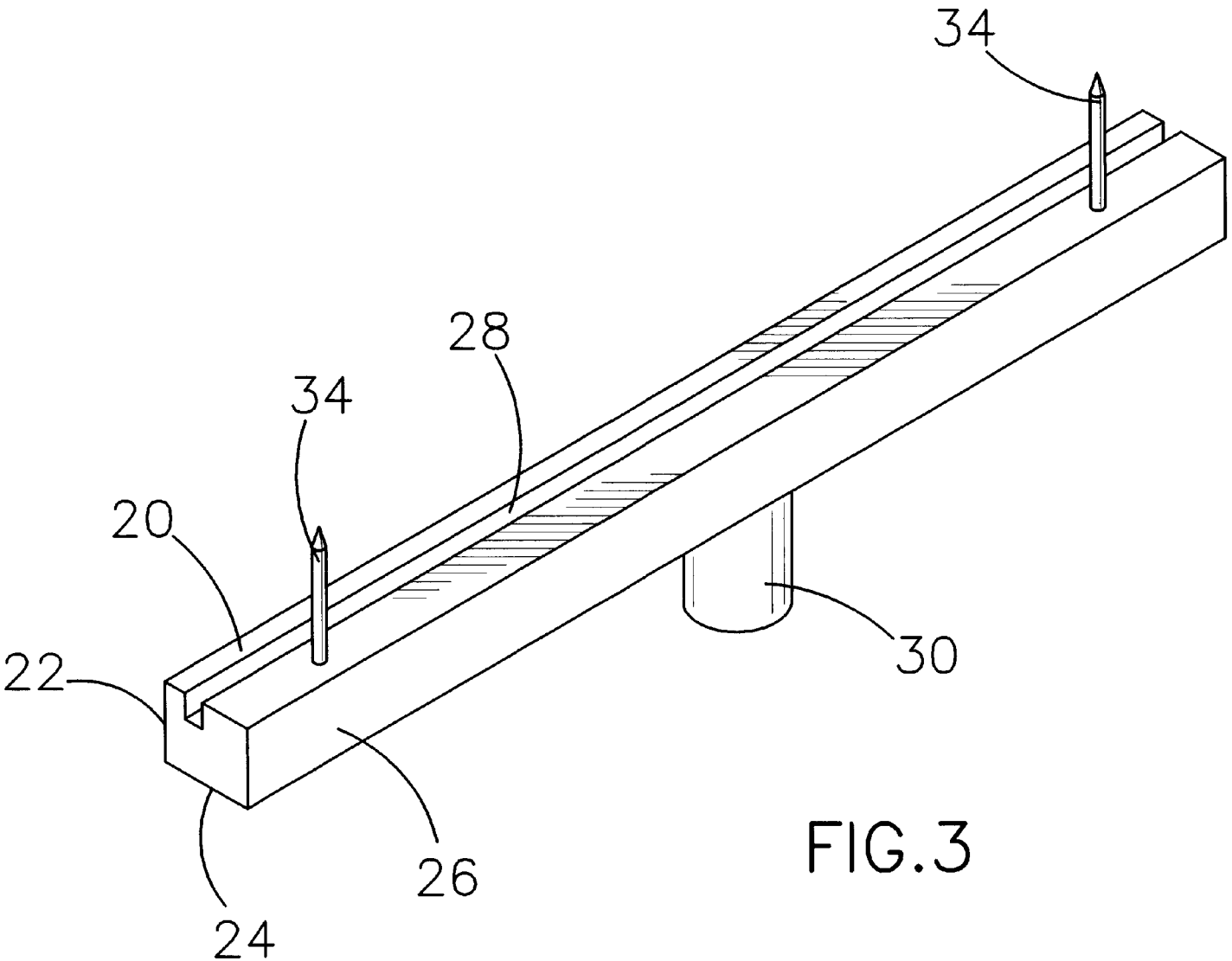
FIG. 3 is a schematic perspective view of the present invention.
Figure 4:
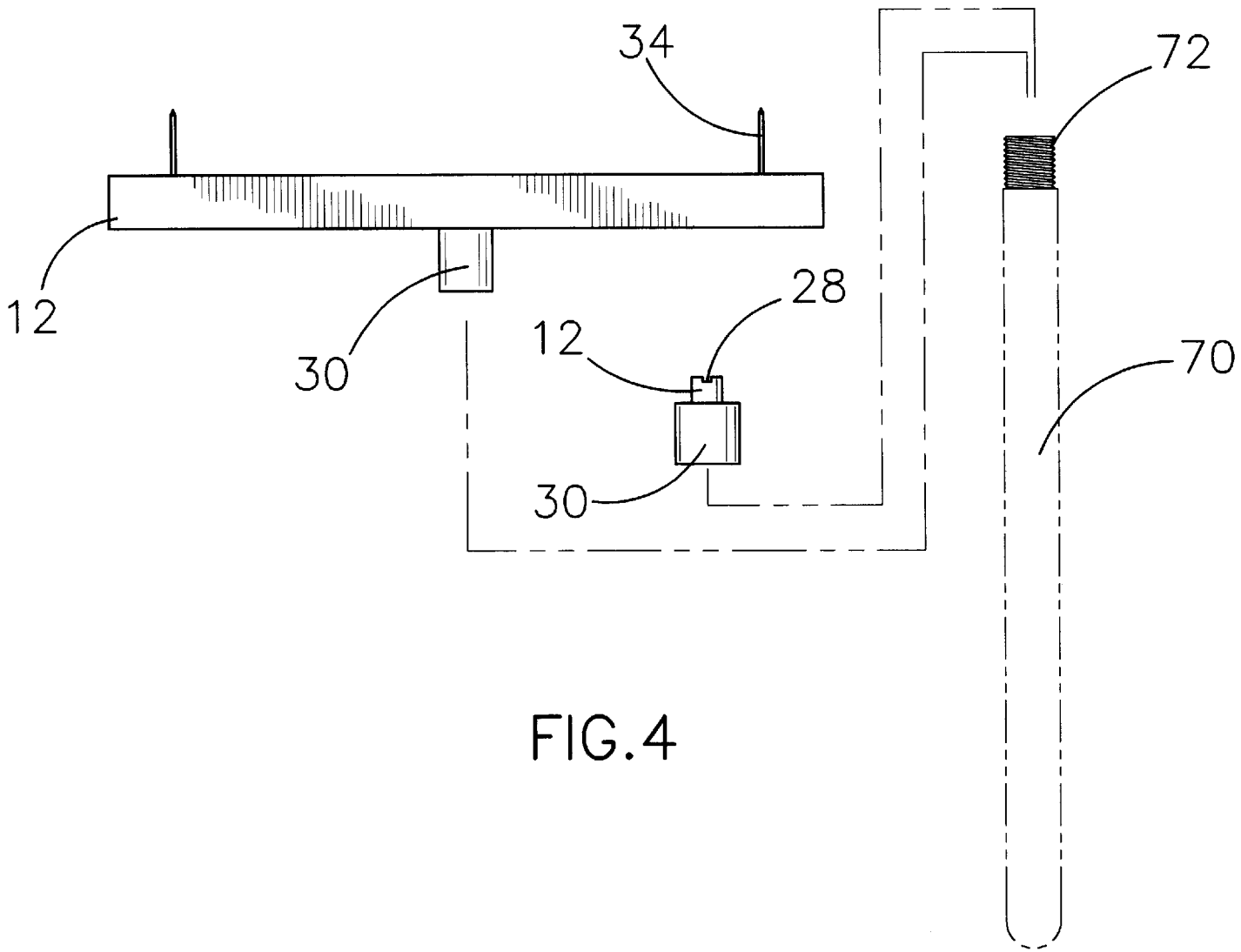
FIG. 4 is a schematic side view of the present invention.

With reference now to the drawings, and in particular to FIGS. 1 through 4 thereof, a new insulation installing tool embodying the principles and concepts of the present invention and generally designated by the reference numeral 10 will be described.

As best illustrated in FIGS. 1 through 4, the insulation installing tool 10 generally comprises an insulation lifting and mounting device. The device 10 is removably coupled to a conventional extension pole 70 used for painting and the like having a male threaded coupler 72.

The device 10 includes an elongate member 12 having a first end 14, a second end 16, and a main portion 18 extending between the first 14 and second 16 ends. The elongate member 12 has a generally rectangular cross-section taken traverse to a longitudinal axis of the elongate member such that the main portion includes a first side 20, a second side 22, a third side 24 and a fourth side 26. The first 20 and third 24 sides are oppositely positioned with respect to each other. An elongated channel 28 is positioned in the main portion 18 and extends between and through the first 14 and second 16 ends of the elongate member 12. The channel 28 is located in the first side 20 of the elongate member 12. The channel 28 is adapted for receiving conventional stay rods used to hold insulation 74 between joists. The stay rod comes out of the channel 28 when it frictionally engages the joists. Splints may also be positioned in the channel 28 for the same purpose.

A coupler 30 is attached to the main portion and is positioned generally between the first 14 and second 16 ends of the elongate member 12. The coupler 30 comprises a female coupling having a threaded opening 32 facing generally away from the elongate member 12. The coupler 30 is attached to the third side 24 of the elongate member 12.

Each of a plurality of upstanding members 34 is attached to and extends away from the main portion 18 of the elongate member 12. The upstanding members 34 extend in a generally opposite way with respect to the coupler 30. Each of the upstanding members 34 has free end 36 which is pointed. Each of the upstanding members 34 is spaced from each other. The plurality of upstanding members 34 preferably comprises two upstanding members. The upstanding members 34 are located in the first side 20 of the main portion 18.

In use, the upstanding members 34 may be removably inserted into insulation 74 for lifting and placing of the insulation. The elongate member 12 is used for pushing the insulation 74 into hard to reach areas and may be used for insertion of stay rods, which are frictionally held by the joists for holding the insulation 74 in place.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An insulation lifting and mounting device, said device being removably coupled to an extension pole, said device comprising:

an elongate member having a first end, a second end, and a main portion extending between said first and second ends;

a coupler being attached to said main portion and being positioned generally between said first and second ends of said elongate member;

a plurality of upstanding members being attached to and extending away from said main portion of said elongate member, said upstanding members extending in a generally opposite way with respect to said coupler, each of said upstanding members having a free end being pointed;

wherein said upstanding members may be removably inserted into insulation for lifting and placing of the insulation; and wherein an elongated channel is positioned in said main portion and extends between and through said first and second ends of said elongate member, said channel being located in a first side of said elongate member.

2. The insulation lifting and mounting device as in claim 1, wherein said elongate member has a generally rectangular cross-section taken traverse to a longitudinal axis of said elongate member such that said main portion includes said first side, a second side, a third side and a fourth side wherein said first and third sides are oppositely positioned with respect to each other, said coupler being attached to said third side.

3. The insulation lifting and mounting device as in claim 1, wherein said coupler comprises a female coupling having a threaded opening facing generally away from said elongate member, said coupler being attached to a third side of said elongate member.

4. The insulation lifting and mounting device as in claim 1, wherein said plurality of upstanding members comprises two upstanding members.

5. The device of claim 1, wherein said elongate member having a length and a width, said length of said elongate member being 6 times said width.

6. An insulation lifting and mounting device, said device being removably coupled to an extension pole, said device comprising:

an elongate member having a first end, a second end, and a main portion extending between said first and second ends, said elongate member having a generally rectangular cross-section taken traverse to a longitudinal axis of said elongate member such that said main portion includes a first side, a second side, a third side and a fourth side wherein said first and third sides are oppositely positioned with respect to each other, an elongated channel being positioned in said main portion and extending between and through said first and second ends of said elongate member, said channel being located in said first side of said elongate member;

a coupler being attached to said main portion and being positioned generally between said first and second ends of said elongate member, said coupler comprising a female coupling having a threaded opening facing generally away from said elongate member, said coupler being attached to said third side of said elongate member;

a plurality of upstanding members being attached to and extending away from said main portion of said elongate member, said upstanding members extending in a generally opposite way with respect to said coupler, each of said upstanding members having a free end being pointed, each of said upstanding members being spaced from each other, said plurality of upstanding members comprising two upstanding members, said upstanding members being located in said first side of said main portion; and wherein said upstanding members may be removably inserted into insulation for lifting and placing of the insulation.

7. The device of claim 6, wherein said elongate member having a length and a width, said length of said elongate member being 6 times said width.

* * * * *